US012392592B2

(12) United States Patent
Pont et al.

(10) Patent No.: US 12,392,592 B2
(45) Date of Patent: Aug. 19, 2025

(54) ELECTRICAL PRIMING OF A FIREARM PRIMER

(71) Applicant: FN HERSTAL S.A., Herstal (BE)

(72) Inventors: Guillaume Pont, Couthuin (BE); Benjamin Istaz, Jeneffe (BE); Hugues Libotte, Jalhay (BE); Patrick Heins, Tilff (BE); Bernard Baps, Couthuin (BE); Romain Santus, Antheit (BE)

(73) Assignee: FN HERSTAL S.A., Herstal (BE)

( * ) Notice: Subject to any disclaimer, the term of this patent is extended or adjusted under 35 U.S.C. 154(b) by 0 days.

(21) Appl. No.: 18/263,789

(22) PCT Filed: Jan. 27, 2022

(86) PCT No.: PCT/EP2022/051912
§ 371 (c)(1),
(2) Date: Aug. 1, 2023

(87) PCT Pub. No.: WO2022/171453
PCT Pub. Date: Aug. 18, 2022

(65) Prior Publication Data

US 2024/0118064 A1 Apr. 11, 2024

(30) Foreign Application Priority Data

Feb. 10, 2021 (EP) ..... 21156325

(51) Int. Cl.
*F42C 19/12* (2006.01)
*F42C 19/08* (2006.01)

(52) U.S. Cl.
CPC ..... *F42C 19/12* (2013.01); *F42C 19/08* (2013.01)

(58) Field of Classification Search
CPC .. F42C 19/08; F42C 19/12; F42B 3/12; F42B 5/08; F42B 5/285; F42B 5/307
See application file for complete search history.

(56) References Cited

U.S. PATENT DOCUMENTS 3,682,096 A * 8/1972 Ludke ..... F42C 19/12 102/202.9
5,044,278 A * 9/1991 Campbell ..... F42B 5/08 42/84

(Continued)

FOREIGN PATENT DOCUMENTS

FR 2438820 A1 5/1980
FR 2823562 A1 10/2002

(Continued)

OTHER PUBLICATIONS

International Search Report and Written Opinion of the International Searching Authority from the European Patent Office, in PCT/EP2022/051912 dated Apr. 21, 2022, which is an international application corresponding to this U.S. application.

*Primary Examiner* — Benjamin P Lee
(74) *Attorney, Agent, or Firm* — Kolitch Romano Dascenzo Gates LLC

(57) ABSTRACT

The present disclosure relates to a primer for a personal firearm. The primer includes a primer cup including a cylindrical side wall closed at one outer end by a bottom; a pyrotechnic charge placed in the primer cup; an electrical component suitable for producing the thermal energy needed for priming the pyrotechnic charge, the charge being in contact with the electrical component; a printed circuit board, said printed circuit board having an internal face comprising the electrical component in contact with the pyrotechnic charge, characterized in that said printed circuit board forms at least in part the outer bottom of the primer cup.

19 Claims, 3 Drawing Sheets

(56) References Cited

U.S. PATENT DOCUMENTS

| | | | | | |
|---|---|---|---|---|---|
| 5,204,491 | A * | 4/1993 | Aureal | F42B 3/198 | 102/202.8 |
| 5,385,097 | A * | 1/1995 | Hruska | F42C 19/12 | 102/202.1 |
| 6,131,515 | A * | 10/2000 | Cook | F42C 19/12 | 102/202.1 |
| 6,247,412 | B1 * | 6/2001 | Vornfett | F42C 19/12 | 102/470 |
| 6,272,993 | B1 * | 8/2001 | Cook | F42B 3/18 | 102/202.1 |
| 6,910,420 | B1 * | 6/2005 | Thompson | F42C 19/12 | 102/202.5 |
| 7,055,434 | B1 * | 6/2006 | Thompson | C06B 33/00 | 102/202.8 |
| 10,415,944 | B2 * | 9/2019 | Winter | F42C 19/12 | |
| 2007/0071678 | A1 * | 3/2007 | Thompson | F42C 19/12 | 424/1.69 |
| 2016/0161237 | A1 * | 6/2016 | Winter | F42B 3/12 | 102/202.7 |

FOREIGN PATENT DOCUMENTS

| | | | | |
|---|---|---|---|---|
| GB | 2068087 | A | 8/1981 | |
| RU | 2602527 | C1 * | 11/2016 | F42B 5/08 |

* cited by examiner

ELECTRICAL PRIMING OF A FIREARM PRIMER

TECHNICAL FIELD

The present disclosure relates to an electric primer and to a small caliber ammunition comprising such an electric primer, a firearm and a related method.

BACKGROUND

The electric priming of small caliber ammunition is known e.g. from U.S. Ser. No. 10/415,944. Such type of primer comprises many assembled parts, with electrical contacts obtained by pressure between the different parts. More particularly, in the present document, a pole piece insulated from the rest of the primer cup by an elastic material comes into electrical contact by pressure on the rear face of a small insulating plate. The front face of said small plate comprises an electrical resistor used for igniting the priming charge, a metalized through hole being used for connecting one terminal of the resistor to the rear face of the small plate, and metalized tracks connecting the other terminal to the walls of the cup. Although such a configuration makes it possible to obtain good mechanical resistance during detonation by using a thick pole piece, same has the drawback of a considerable assembly complexity on top of the risk of poor electrical contact, or even of poor contact.

SUMMARY

The aim of the present disclosure is to remedy at least one of the drawbacks of the aforementioned prior art. More particularly, the subject matter of the present disclosure is to adapt a priming to small or medium calibers without entailing additional cost.

By small or medium caliber, we mean portable personal weapons, as opposed to weapon systems requiring the intervention of several users. More particularly, the present disclosure relates to so-called "less lethal" launchers (or weapons) wherein the energy density at impact (energy of the projectile at impact divided by the impact surface area) is low, i.e. generally less than 100 J/cm$^2$, preferentially less than 50 J/cm$^2$, typically 30 J/cm$^2$). Advantageously, the kinetic energy density at impact is nevertheless at least 7 J/cm$^2$, preferentially at least 15 J/cm$^2$.

The present disclosure relates to a primer for a personal firearm comprising:

- a primer cup including a cylindrical side wall closed at one outer end by a bottom;
- a pyrotechnic (or explosive) charge placed in the primer cup;
- an electrical component suitable for producing the thermal energy needed for igniting the pyrotechnic charge, said charge being in contact with the electrical component;
- a printed circuit board, said printed circuit board comprising an internal face comprising the electrical component in contact with the pyrotechnic charge,
- characterized in that said printed circuit board forms at least in part, the external bottom of the primer cup.

According to advantageous embodiments of the present disclosure, the primer comprises one or a plurality of the following technical characteristics, in any suitable combination:

- said internal face of the printed circuit board has a surface area representing at least 40%, preferentially at least 60%, in particular at least 70% and in particular at least 80% of the surface area defined by $\pi/4 \cdot D^2$, D being the diameter of the primer;
- an outer face of the printed circuit board is flush with the rear base of the cylindrical side wall of the primer cup;
- the printed circuit board is in the form of a disk including a shoulder configured so that the printed circuit board can be inserted by form-fitting into the primer cup;
- the two cylindrical surfaces of different diameters are connected to each other at one end by the annular shoulder, the two cylindrical surfaces being closed by the inner face and the outer face, respectively, at the other end thereof;
- the printed circuit board comprises a conductive annular portion, the primer cup being in electrical contact with the printed circuit board either via a conductive washer abutting against said conductive annular portion and against a corresponding portion of an inner surface of the cylindrical side wall of the primer cup, or, either via a conductive adhesive or a brazing applied between said conductive annular portion and a corresponding portion of an inner surface of the cylindrical side wall of the primer cup;
- the printed circuit board comprises a first electrode crossing through a central portion of the printed circuit board, said electrode extending from the inner face to the outer face and a second electrode with annular shape and positioned at the periphery of the printed circuit board;
- the first electrode has two ends, one of which is connected to the electrical component and the other to a conductive plate, preferentially without perforation arranged on the external face of the printed circuit board;
- the electrical component is electrically connected to the second electrode;
- the electrical component comprises a resistor suitable for initiating the pyrotechnic charge;
- an annular radial projection extends from the end of the lateral cylindrical wall towards the inside of the primer and a lateral face of said protrusion abuts against the shoulder of the printed circuit board;
- the outer face of the printed circuit board is flush with the other radial lateral face of the annular radial protrusion;
- the electrical component is positioned on the axis of the primer cup;
- the pyrotechnic charge is a primary charge configured for initiating the ignition;
- The primer (2) according to any of the preceding claims, characterized in that at least a portion of a peripheral edge of the printed circuit board (16) bears against a corresponding portion of the cylindrical side wall (6).

The present disclosure further relates to an ammunition comprising a primer according to the present disclosure, characterized in that the ammunition comprises a projectile, in particular a less lethal projectile.

The present disclosure further relates to a firearm comprising a priming electric circuit comprising a control unit for measuring a quantity of the electric circuit of the ammunition of the present disclosure when the ammunition is arranged in the firearm, said control unit determining, according to said measurement, the presence of an ammunition according to the present disclosure.

The measurements of the present disclosure are advantageous in that same make it possible to advantageously combine the field of cartridge production (essentially deep-drawing) and the field of electronics (electronic board assembly).

By using both a largely industrialized mechanical part, the primer cup, and an electronic part which is also widely industrialized, a printed circuit board, it is possible to produce a simple and thus inexpensive overall assembly.

Moreover, a printed circuit board has good insulating properties, and a fire resistance suitable for the constraints of using a firearm.

Such type of primer is particularly suitable for so-called "less lethal" weapons wherein the pyrotechnic charges used for projecting the projectile are reduced, reducing in proportion, the mechanical stress on the bottom of the cartridge.

Finally, the measurements of the present disclosure which improve the safety of use can advantageously serve as a fool proof means.

LEGEND

Figure 1:
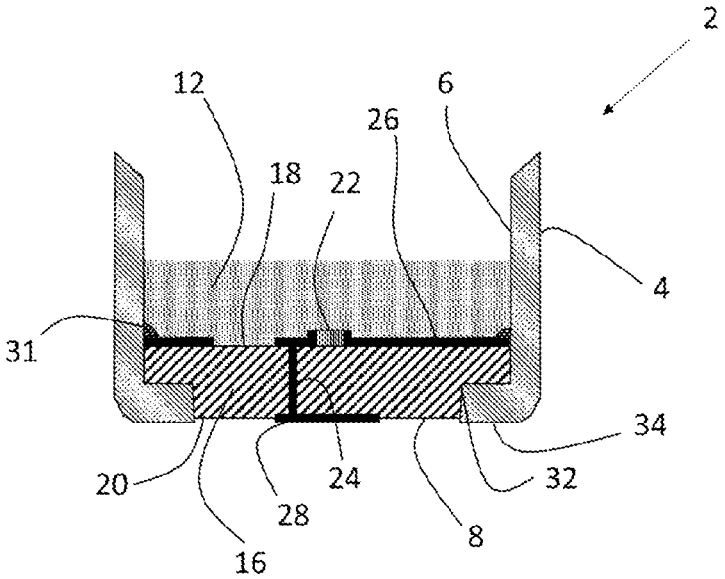
FIG. 1 shows a transverse section of an example of a primer according to the present disclosure.

1. Ammunition
2. Primer
4. Primer cup
5. Cartridge case side wall
6. Primer cylindrical side wall
8. Bottom
10. Projectile
12. Primary charge
14. Secondary charge
16. Printed circuit board
18. Internal face of the printed circuit board
20. Outer face of the printed circuit board
22. Electrical component (Resistor)
24. First electrode
26. Second electrode
28. Conductive plate
30. Conductive washer
31. Conductive brazing
32. Annular shoulder
34. Annular radial protrusion
36. Additional annular plate
38. Electrical contactors
42. Voltage source
44. Capacity

DETAILED DESCRIPTION

Figure 3:
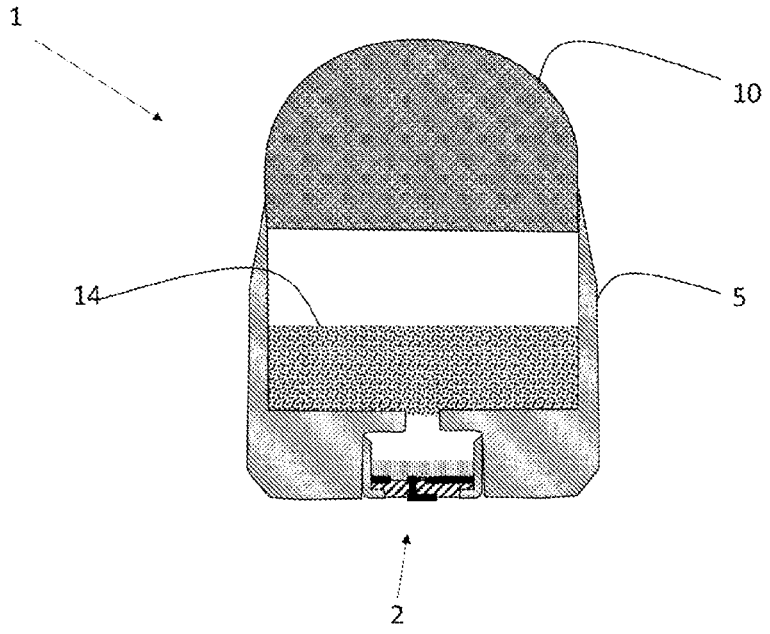
FIG. 3 shows an ammunition comprising a primer according to the present disclosure.

FIG. 1 shows a schematic view of the structure of a primer 2 according to the present disclosure. The primer 2 comprises a primer cup 4 including a cylindrical side wall 6, one end of which is closed by a bottom 8 and the other end, open, is suitable for being inserted into an ammunition 1. The primer 2 comprises a pyrotechnic charge 12, called primary charge 12. The primary charge 12 can be configured for optimizing the ignition of a secondary charge 14 comprised in the munition 1 (cf. FIG. 3), or serve directly as a propelling charge, in particular, advantageously in the case of low-power ammunitions such as for less lethal launchers.

By "less lethal launcher", we mean launchers with reduced probability of causing serious injuries. Less lethality can be obtained by the use of particular projectiles with a low penetration (plastic projectile, rubber, breakable envelope comprising shot disintegrating on impact, etc.) and/or reduced density of kinetic energy (i.e. the kinetic energy divided by the impact surface area being typically on the order of 30 joules/$cm^2$). Such projectiles can nevertheless be disabling, causing pain and/or a recoil effect sufficient for deterring an aggressor from continuing their action. The projectiles can also be used, in the case of certain projectiles, for "marking" the target by means of easy to identify dyes.

In FIG. 1, a printed circuit board 16 (PCB) has two opposite faces 18, 20, said circuit 16 forming at least in part, the bottom 8. The two opposite faces comprise an inner face 18 oriented towards the front of the primer 2 along the direction of firing and an outer face 20 oriented towards the rear. Preferentially, the opposite faces 18, 20 are circular. The printed circuit board 16 includes at least one electrical component 22, in particular a resistor 22, or even a plurality of resistors arranged in parallel or in series so as to optimize (multi-point ignition) or guarantee, by redundancy, the priming of the pyrotechnic charge 12. The resistor or resistors 22 are arranged on the internal face 18 (facing the pyrotechnic charge 12) of the printed circuit board 16 so that at least the resistor or resistors 22 are in thermal contact with the pyrotechnic charge 12. FIG. 1 shows an embodiment with a resistor 22 which is connected in series to a first electrode 24 and a second electrode 26. Preferentially, the first electrode 24 is arranged in a central portion of the printed circuit board 16. The first electrode 24 comprises a conductive rear face 28, a via crossing through the PCB and a front contact in electrical contact with the electrical component 22.

The electrical component 22, in particular an electronic compound, preferentially a resistor 22, makes it possible to initiate, by heating, the primary pyrotechnic charge 12. For example, the component is either a resistor 22 mounted by means of an automatic placement machine widely used in electronics, or a simple track, the width of which being calculated to be heated to the desired temperature (or even to be melted).

Advantageously, the electrical component 22 can comprise a metal or an alloy wire or strip connected to two connection pieces, where said wire or strip can be in direct contact with the pyrotechnic (primary) charge 12.

Figure 4:
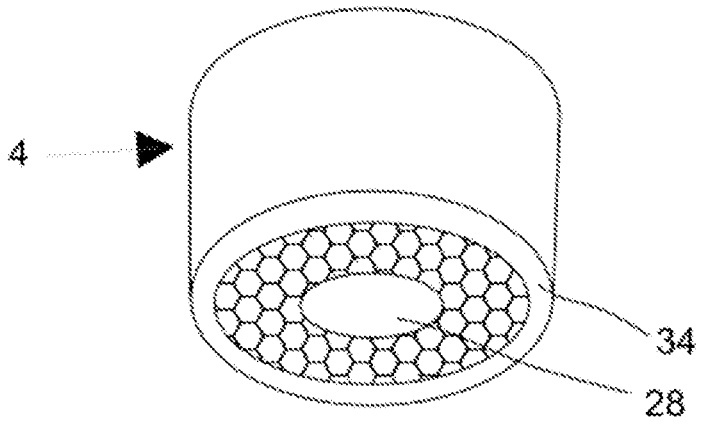
FIG. 4 shows a rear perspective view of a primer cup according to the present disclosure.
Figure 5:
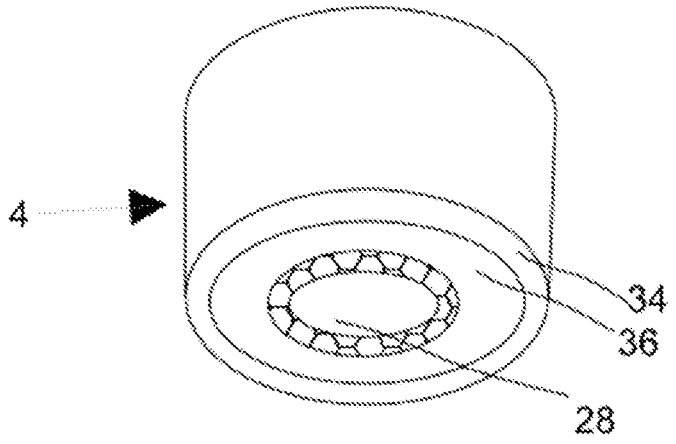
FIG. 5 shows a rear perspective view of a primer cup according to the present disclosure.
Figure 6:
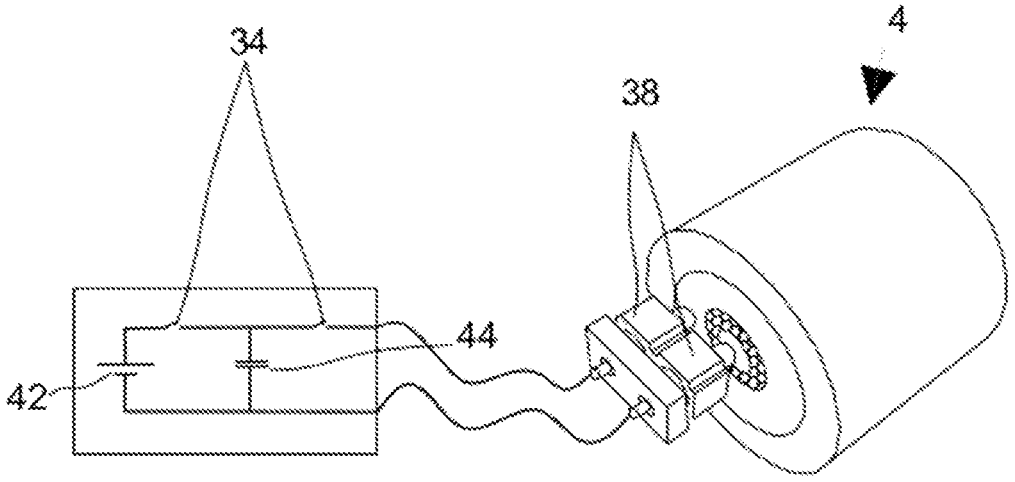
FIG. 6 shows a priming circuit and an interface suitable for primers according to the present disclosure.

The first electrode 24 consists of a conductive material such as a metal. One end of the first electrode 24 is rigidly attached to a conductive plate 28 arranged on the external face 20 of the printed circuit board 16 as illustrated in FIGS. 4 and 5. The other end of the primary electrode is connected to a terminal (conductive part) of the resistor 22. The other terminal (conductive part) of the resistor 22 can be rigidly attached to an electrically conductive element arranged radially on the printed circuit board 16, extending from the periphery thereof to the central portion thereof, where said element can be rigidly attached to the second electrode when the second electrode is formed on the periphery of the printed circuit board 16.

Figure 2:
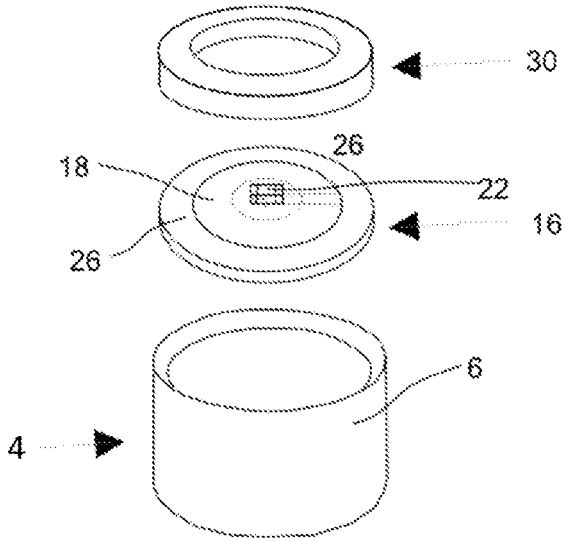
FIG. 2 shows an exploded view of an example of a primer cup according to the present disclosure.

FIG. 2 shows an exploded view of a primer 2 according to the present disclosure, comprising a primer cup 4, a printed circuit board 16 and an attachment washer 30. The printed circuit board 16 can be in the form of a plate, more particularly a disk comprising a plastic material preferentially with a polymer matrix. Such material advantageously comprises a filler of mineral fibers such as glass fibers, either woven or not woven. An example of such type of material is an epoxy/fiberglass composite. The printed circuit board 16 can be delimited laterally by two cylindrical surfaces with different diameters, connected by an annular shoulder 32. The second electrode 26 can be formed at the periphery of the printed circuit board 16. The second electrode 26 can be an electrically conductive annular plate.

As shown in FIG. 2, the washer 30 is held by friction in the primer cup 4. The washer 30 can abut against a peripheral portion of the printed circuit board 16 and an inner surface portion of the primer cup 4. The washer 30 can be made of a current-conducting material, such as metal. The washer 30 can also serve as means of holding the printed circuit board 16. Indeed, when the cylindrical side wall 6 of the primer cup 4 has an annular radial protrusion 34 directed towards the center of the primer 2, the printed circuit board 16 is sandwiched ("squeezed") between the annular radial protrusion 34 (forming an annular surface in contact with a peripheral edge of the printed circuit board 16) and the washer 30.

According to a preferred alternative, and as shown in FIG. 1, the printed circuit board is held in place by a conductive adhesive or by brazing forming a brazing ring 31 between the cylindrical side wall 6 and a conductive annular zone at the periphery of the inner face 18 of the printed circuit board 16.

The choice of the ratio between the internal surface 18 of the printed circuit board 16 and the surface defined by $\pi/4D^2$ where $\pi$=3.1415 and D defines the diameter of the primer 2 is determined by the diameter D of the primer 2 and the desired level of electrical insulation of the printed circuit board 16. A surface ratio defined by the following ranges: at least 50%, preferentially at least 60%, more particularly at least 70% and in particular at least 80%, provides optimized operation of the primer 2.

An electrical circuit of the primer 2 described in FIG. 1 comprises in series at least one or all of the following components integral with the printed circuit board 16: the conductive plate 28 (central), the first electrode 24, the electrical component 22 (resistor), the radial conductive element, the annular plate, and at least one or all of the following components rigidly attached to the primer cup 4: the washer 30 (or a conductive adhesive or conductive brazing), the cylindrical side wall 6, the annular radial protrusion 34 and optionally an additional concentric annular plate 36 contiguous with said protrusion as illustrated in FIG. 5. The solution shown in FIG. 5 makes it possible to bring the electrical contactors 38 closer together without the annular radial protrusion 34 being prolonged. The annular radial protrusion 34 can be obtained by a deformation of the primer cup 4.

Preferentially, the central conducting plate 28 and the annular radial protrusion 34 or the additional annular plate 36 serve as electrical contacts with the electrical contactors 38 arranged on the firearm as illustrated in FIG. 5 (solution with additional annular plate 36, see FIG. 4).

FIG. 5 shows a schematic perspective view of the priming system at the firearm. The electrical interface between the firearm and the primer 2 can comprise two electrical contactors 38 intended for being held in abutment against the bottom 8 by means of return (e.g. springs) when the primer is housed in the breech.

The power supply circuit can be capacitive. A capacitive circuit is well known e.g. in the automotive field for ignition. Typically, a capacitive circuit includes one or a plurality of electronic switches, in particular at least one transistor 40 configured for controlling the flow of current, at least one voltage source 42 and/or current, as well as a capacitor 44 configured for initially accumulating electrical energy which will then be restored and partially dissipated in the resistor 22 of the primer 2 after the closing of the electrical circuit by at least one of the transistors 40 after a firing request. Electronic switch 40 also refers to a power switch/transistor which can absorb the current peak occurring in the electrical circuit when the electrical component 22, in particular the resistor 22, is short-circuited with the capacitor 44.

The firearm according to the present disclosure also makes it possible to avoid the priming of a primer not in conformity with the firearm which would have been housed by mistake in the breech, thereby improving the safety of use by mechanical fool proofing (e.g. dimension of the primer) and electronic fool proofing (e.g. predefined electrical response to an electrical signal produced by the firearm).

At least one of the electrical contactors 38 exerts a very small force on the base (i.e. the rear face of the bottom 8 of the primer cup 4) of the primer, i.e. less than 10 N or even less than 1 N. Thus, no risk of percussion of the primer is conceivable with a firearm according to the present disclosure.

In addition, the firearm comprises a device configured for performing the steps of a safety process (electronic fool proofing):

measuring an electrical quantity of an electrical circuit, such as the resistance;

deactivating the fire control (or alert the user by means of a signal, in particular an audible, a vibratory and/or a visible signal) when the detected quantity is outside a predefined range of values.

More particularly, the resistor 22 (or the filament serving as resistance) has a low heat resistance so that the ignition of the primary charge destroys same. In this way, the detection of infinite resistance on the priming circuit makes it possible to determine that the loaded ammunition has already been used and needs to be replaced. Such feature is particularly useful in the case of multiple munitions placed in a circuit provided for a sequential ignition of different cartridges loaded simultaneously.

The invention claimed is:

1. A primer for a personal firearm, the primer comprising:

a primer cup including a cylindrical side wall closed at one outer end by a bottom;

a pyrotechnic charge placed in the primer cup;

an electrical component configured to produce thermal energy to ignite the pyrotechnic charge, the charge being in contact with the electrical component; and a printed circuit board including an inner face comprising the electrical component in contact with the pyrotechnic charge and a non-conductive external face, wherein a conductive plate is disposed on the non-conductive external face; and wherein the non-conductive external face of the printed circuit board forms at least in part the bottom of the primer cup, such that at least a portion of the non-conductive external face and the conductive plate are exposed.

2. The primer according to claim 1, wherein the inner face has a surface area representing at least 40% of the surface area defined by $\pi/4 \cdot D^2$, wherein D is a diameter of the primer.

3. The primer according to claim 1, wherein the non-conductive external face of the printed circuit board is flush with a rear base of the cylindrical side wall of the primer cup.

4. The primer according to claim 1, wherein the printed circuit board is in the form of a disk including an annular shoulder configured to permit the printed circuit board to be inserted by form-fitting into the primer cup.

5. The primer according to claim 4, wherein the printed circuit board includes two cylindrical surfaces having different diameters and connected to one another by the annular shoulder, wherein the two cylindrical surfaces are closed by the inner face and the non-conductive external face of the printed circuit board.

6. The primer according to claim 1, wherein the printed circuit board comprises a conductive annular portion, the primer cup being in electrical contact with the printed circuit board via a conductive washer abutting against the conductive annular portion and against a corresponding portion of an inner surface of the cylindrical side wall of the primer cup.

7. The primer according to claim 1, wherein the printed circuit board comprises a first electrode crossing through a central portion of the printed circuit board, wherein the first electrode extends from the inner face to the non-conductive external face, and wherein the printed circuit board includes a second electrode having an annular shape positioned at a periphery of the printed circuit board.

8. The primer according to claim 7, wherein the first electrode has two ends, wherein a first end of the first electrode is connected to the electrical component and a second end of the first electrode is connected to the conductive plate disposed on the non-conductive external face of the printed circuit board.

9. The primer according to claim 7, wherein the electrical component is electrically connected to the second electrode.

10. The primer according to claim 1, wherein the electrical component comprises a resistor configured to initiate the pyrotechnic charge.

11. The primer according to claim 1, wherein an annular radial protrusion extends from the outer end of the cylindrical side wall towards an inside of the primer and a lateral face of the annular radial protrusion abuts against a shoulder of the printed circuit board.

12. The primer according to claim 1, wherein the electrical component is positioned on a central axis of the primer cup.

13. The primer according to claim 1, wherein the pyrotechnic charge is a primary charge configured to initiate the ignition.

14. The primer according to claim 1, wherein at least a portion of a peripheral edge of the printed circuit board bears against a corresponding portion of the cylindrical side wall.

15. Ammunition comprising a primer according to claim 1, wherein the ammunition comprises a projectile.

16. The ammunition of claim 15, wherein the projectile comprises a less lethal projectile.

17. The primer according to claim 1, wherein the printed circuit board comprises a conductive annular portion, the primer cup being in electrical contact with the printed circuit board via a conductive adhesive or brazing applied between the conductive annular portion and a corresponding portion of an inner surface of the cylindrical side wall of the primer cup.

18. A primer for a personal firearm, the primer comprising:

a primer cup including a cylindrical side wall closed at one outer end by a bottom;

a pyrotechnic charge placed in the primer cup;

an electrical component configured to produce thermal energy to ignite the pyrotechnic charge, the charge being in contact with the electrical component; and a printed circuit board including an inner face comprising the electrical component in contact with the pyrotechnic charge;

wherein the printed circuit board forms at least in part the bottom of the primer cup, wherein the printed circuit board comprises a conductive annular portion, and wherein the primer cup is in electrical contact with the printed circuit board via a conductive washer abutting against the conductive annular portion and against a corresponding portion of an inner surface of the cylindrical side wall of the primer cup.

19. A primer for a personal firearm, the primer comprising:

a primer cup including a cylindrical side wall closed at one outer end by a bottom;

a pyrotechnic charge placed in the primer cup;

an electrical component configured to produce thermal energy to ignite the pyrotechnic charge, the charge being in contact with the electrical component; and a printed circuit board including an inner face comprising the electrical component in contact with the pyrotechnic charge;

wherein the printed circuit board forms at least in part the bottom of the primer cup, and wherein an annular radial protrusion extends from the outer end of the cylindrical side wall towards an inside of the primer and a lateral face of the annular radial protrusion abuts against a shoulder of the printed circuit board.

* * * * *